US007484990B1

(12) United States Patent
Lee et al.

(10) Patent No.: US 7,484,990 B1
(45) Date of Patent: Feb. 3, 2009

(54) CABLE CONNECTOR RETENTION DEVICE

(75) Inventors: Noel Lee, Las Vegas, NV (US); Kendrew Lee, San Jose, CA (US)

(73) Assignee: Monster Cable Products, Inc., Brisbane, CA (US)

( * ) Notice: Subject to any disclaimer, the term of this patent is extended or adjusted under 35 U.S.C. 154(b) by 0 days.

(21) Appl. No.: 11/849,961

(22) Filed: Sep. 4, 2007

(51) Int. Cl.
*H01R 13/62* (2006.01)

(52) U.S. Cl. ..... 439/369

(58) Field of Classification Search ..... 439/369, 439/371, 373
See application file for complete search history.

(56) References Cited

U.S. PATENT DOCUMENTS 2,913,791 A * 11/1959 Martin ..... 24/136 R
4,143,934 A * 3/1979 Siebert ..... 439/369
4,204,738 A * 5/1980 Tillotson ..... 439/369
5,044,976 A * 9/1991 Thompson ..... 439/368
5,217,387 A * 6/1993 Hull et al. ..... 439/367
5,306,176 A * 4/1994 Coffey ..... 439/367
6,981,888 B2 * 1/2006 O'Keefe et al. ..... 439/369
7,134,902 B1 * 11/2006 Lewis et al. ..... 439/373
7,207,826 B1 * 4/2007 Yang ..... 439/373
2004/0166718 A1 * 8/2004 Yoest ..... 439/369

* cited by examiner

*Primary Examiner*—Tho D Ta
(74) *Attorney, Agent, or Firm*—LaRiviere, Grubman & Payne, LLP

(57) ABSTRACT

A cable retention device coupled at one end to a connector housing, having a tubular grip disposed at a second end for securing a cable at or near its strain-relief boot.

5 Claims, 3 Drawing Sheets

CABLE CONNECTOR RETENTION DEVICE

TECHNICAL FIELD

The present invention relates to interconnection of electrical signal cables. In particular, the present invention provides a retention device for securing coupling of cable connectors.

BACKGROUND ART

The rapid advance of technology continues to drive the proliferation of different types of cables and connectors. As new standards are promulgated and adopted, so new cables are designed and sold. In a typical household, it is not uncommon to find a computer, a home theater system, and assorted other electronic devices. Associated with these devices are many cable types such as USB, Firewire, UDP, HDMI, RCA, etc.

Any cable connection is susceptible to events that may dislodge it and thereby disrupt its intended purpose. Such events may also damage the cable or its socket, or potentially degrade their functionality. Furthermore, even if no damage occurs, the user must go through the hassle of reconnecting the cable. If the location of the connection is easily accessible, this may be a minor inconvenience. However, the tendency in modern design is to place cables so that they are unobtrusive or altogether hidden. Often this means that cables are connected in places that are difficult to reach, such as behind furniture or in walls or ceilings. Thus, reconnecting a dislodged cable can present quite a problem for the user.

To deal with this problem, some cable connector designs include mechanisms to help prevent their disconnection. For example, a typical serial port connection for a computer is secured by a couple of screws located adjacent to the connector. However, many cable connector types, such as USB and HDMI, do not have adequate security for preventing dislodgement or poor coupling and pin connections. These connectors are held in place by little more than the friction and rigidity of the pin-to-socket connection and connector shell portions surrounding the pins and sockets, all of which having varying and depletable degrees of inference fit.

Therefore, a need exists for a cable connector retention device to protect cables and sockets against events that may cause them to become disconnected or damaged, or cause poor pin-to-socket signal transmission.

DISCLOSURE OF THE INVENTION

A cable connector retention device coupled at one end to a connector, having a tubular grip disposed at a second end for securing a cable at or near its strain-relief boot. In a second embodiment, the cable retention device of the present invention comprises a coupler for receiving opposed cable connectors, the opposite sides of which having retention devices coupled thereto each of which extending lengthwise along the cables connected thereto and having tubular grips disposed at each end thereof for securing the cables at or near their respective strain-relief boots. A tubular grip according to the present invention generally includes a substantially tapered internal diameter having spiral or parallel grooves or ribs formed therein for applying increasing interference fit with the cable inserted therein.

The present invention serves to retain a cable in a connected position by grasping the cable along its length at or near to its strain-relief boot. The cable is thus secured by the action of the grip in both grasping the cable as well as buttressing the strain-relief boot. Furthermore, the invention provides additional strain relief to the cable and reduces stress on the cable connector.

BEST MODES FOR CARRYING OUT THE INVENTION

For the purposes of this patent application, a typical connector includes a connector shell or housing, a strain-relief boot, and electrical contacts such as a plug or socket.

Figure 1:
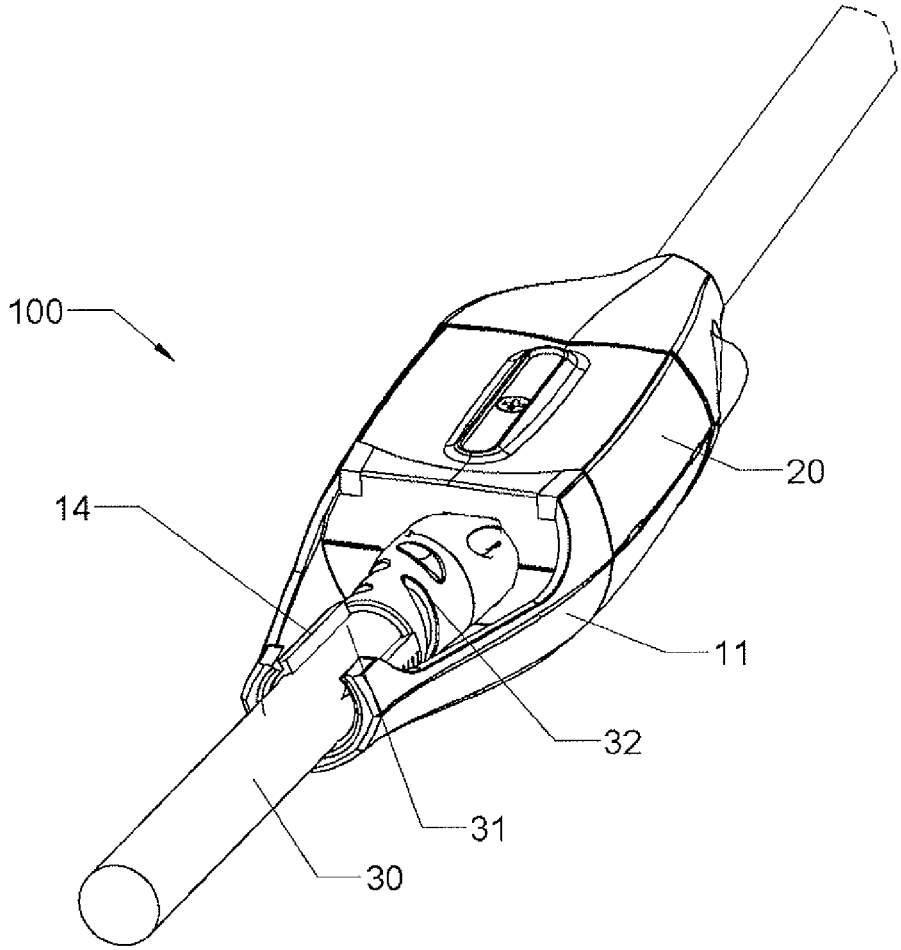
FIG. 1 is a perspective view of an embodiment of the present invention showing a cable connected thereto.

FIG. 1 illustrates, in a perspective view, an embodiment 100 of the present invention, comprising a segment 11 coupled at one end to connector 20. Segment 11 extends lengthwise along a cable 30 that is connected to connector 20. A second end of segment 11 is coupled to a tubular grip 14. Grip 14 secures the cable in place by grasping the cable along a length 31 at or near its strain-relief boot 32.

Figure 2:
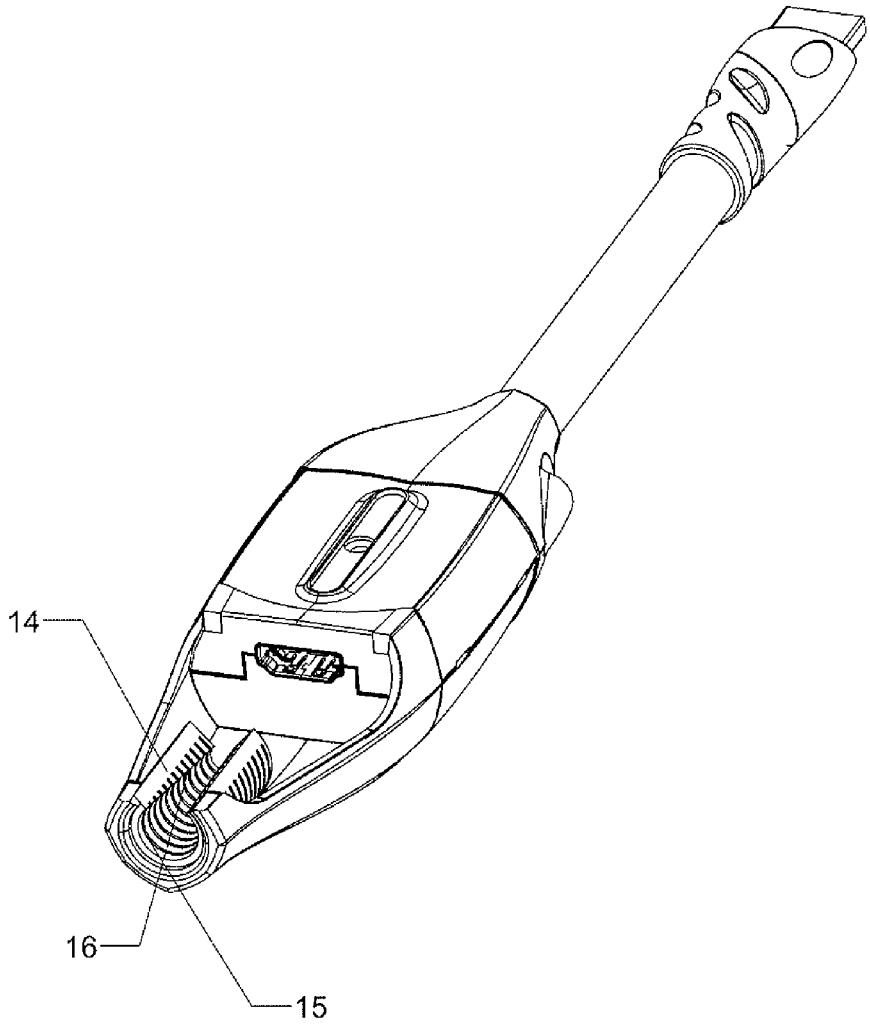
FIG. 2 is a perspective view of the embodiment of FIG. 1 without the cable connected thereto.

As shown in FIG. 2, in an embodiment of the present invention, grip 14 comprises a tube with a portion of its periphery cut away, resulting in a C-shaped cross section. A series of parallel or spiraled grooves 15 are formed along the internal surface 16 of grip 14, which is tapered or conically contoured to provide increasing interference fit along its length with the surface of cable 31 at or near its strain-relief boot 32. The grip 14 may be composed of any material that is flexible enough to accommodate insertion of a cable, yet rigid enough to provide adequate support and protection.

In another embodiment of the present invention (not shown), the tubular grip has no portion cut away, resulting in a cylindrical cross section.

In another embodiment of the present invention (not shown), a series of parallel or spiraled ribs is formed on the internal surface of the tubular grip.

Those skilled in the art will recognize that alternative means for grasping the cable may be substituted without departing from the essence of the present invention. For example, the grip may comprise alternative tube shapes in order to accommodate different cable shapes, such as square or rectangular.

In another embodiment of the present invention, the segment 11 is detachably coupled to the connector housing 20. This allows the device to be first attached to a cable 30, and subsequently attached to the connector 20 as the cable 30 is connected to the connector 20.

In another embodiment of the present invention, the grip 14 is detachably coupled to the segment 11. This allows the grip 14 to be first attached to a cable 30, and then attached to the segment 11 as the cable 30 is connected to the connector 21.

Figure 3:
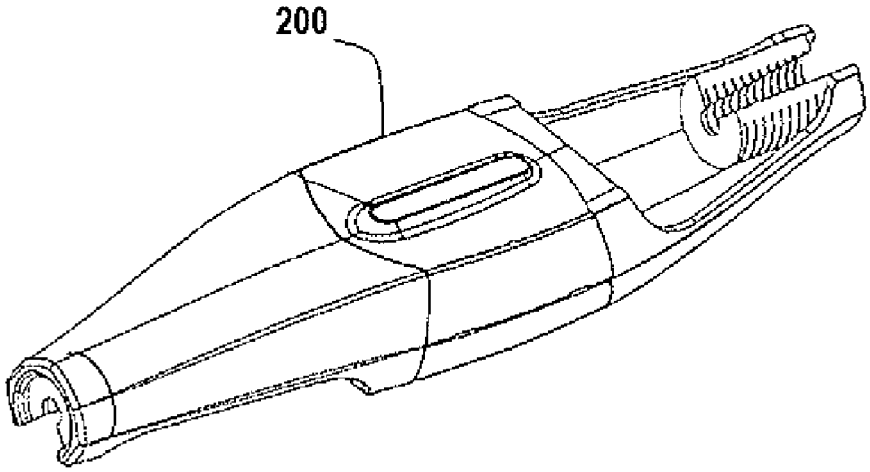
FIG. 3 is a perspective view of a second embodiment of the present invention.

FIG. 3 illustrates, in a perspective view, a second embodiment of the present invention which comprises coupler 200 having two of the presently described cable retention devices which are coupled to an adapter at opposing ends. This embodiment provides support and protection for two cables that are linked by the adapter. As such a linkage is often employed to extend cables, this embodiment represents a particularly useful application of the invention because extended cables run for long distances and are thus especially susceptible to events that may dislodge their connections.

No special materials are required to construct the retention device of the present invention. Typically, the device can be molded in one or several pieces, depending on desired configuration, using the same materials used in the construction of cable connector shells and boots. In particular, it may be desirable to form tubular grip 14 separately for fixed attachment to segment 11 during assembly.

INDUSTRIAL APPLICABILITY

The present invention applies industrially to a cable connector retention device for computer, home theater systems, and interconnection of assorted other electronic devices including flat screen video displays and the like. Associated with these devices are many cable types such as USB, Firewire, UDP, HDMI, RCA, etc.

What is claimed is:

1. A cable retention device for retaining connection of a cable having a strain-relief boot in a connected position, said cable retention device comprising:

a segment having a first and second end;

said first end being coupled to a connector, and a grip for grasping a major portion of the circumference of said cable at or near its strain-relief boot, said grip includes a substantially tapered internal diameter for applying increasing interference fit directly with said major portion of the circumference of said cable.

2. The cable retention device of claim 1 wherein said grip comprises a substantially C-shaped cross section.

3. The cable retention device of claim 1 wherein a series of parallel or spiraled grooves is formed on the internal surface of said grip.

4. The cable retention device of claim 1 wherein said grip comprises a substantially C-shaped cross section, and a series of parallel or spiraled grooves is formed on the internal surface of said grip.

5. A method of retaining a cable having a strain-relief boot in a connected position, said method comprising the steps of:

(1) providing a segment having a first and second end;

(2) coupling said first end to a connector;

(3) grasping a major portion of the circumference of said cable at or near its strain-relief boot, when said cable is connected to said connector;

(4) applying increasing interference fit directly to said major portion of the circumference of said cable.

* * * * *